US006038725A

United States Patent [19]

Knapp

[11] Patent Number: 6,038,725

[45] Date of Patent: Mar. 21, 2000

[54] UNICAST PARAFFIN REMOVING PIPELINE PIG INCORPORATING MULTIPLE DIAMETER AND THICKNESS DISCS AND HAVING A CENTRAL BENDING PORTION FOR TURNS

[76] Inventor: Kenneth M. Knapp, 1209 Hardy, Houston, Tex. 77020

[21] Appl. No.: 08/624,184

[22] Filed: Mar. 29, 1996

[51] Int. Cl.[7] ..... B08B 9/04

[52] U.S. Cl. ..... 15/104.061; 166/153

[58] Field of Search ..... 15/3.5, 104.061; 137/244, 245; 166/153

[56] References Cited

U.S. PATENT DOCUMENTS

| | | | |
|---|---|---|---|
| 2,276,109 | 3/1942 | Smith | 15/104.061 |
| 2,544,290 | 3/1951 | Bailey | 15/104.061 |
| 2,763,017 | 9/1956 | Redin | 15/104.061 |
| 4,069,535 | 1/1978 | Cato | 15/104.061 |
| 4,603,449 | 8/1986 | Knapp . | |
| 4,663,795 | 5/1987 | Neff | 15/104.061 |
| 4,726,089 | 2/1988 | Knapp | 15/14.061 |

*Primary Examiner*—Charles E. Cooley
*Assistant Examiner*—Terrence Till

[57] ABSTRACT

A bendable, unicast pig formed of polyurethane is disclosed. It has symmetrical front and rear end discs, seal discs there between and can wipe paraffin from a pipe. The body is devoid of intermediate discs to bend about 15° or more.

22 Claims, 1 Drawing Sheet

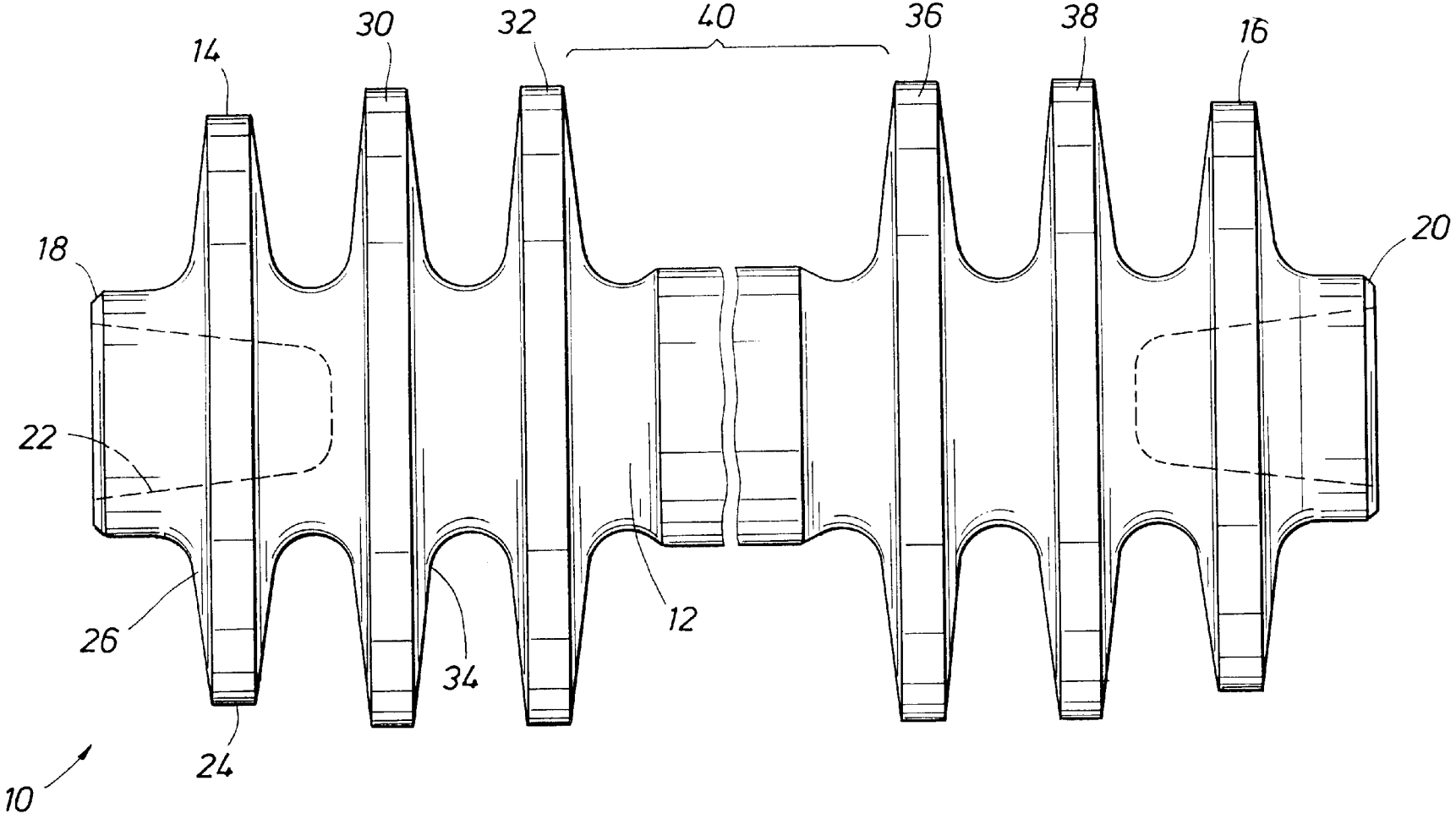
20
16
38
36
40
12
32
34
30
14
24
26
18
22
10

UNICAST PARAFFIN REMOVING PIPELINE PIG INCORPORATING MULTIPLE DIAMETER AND THICKNESS DISCS AND HAVING A CENTRAL BENDING PORTION FOR TURNS

This disclosure is directed to a unicast pipeline pig typically formed polyurethane which enables transmission along a pipeline to remove paraffin. It is a pipeline pig which is especially constructed to enable turning of the pig by virtue of a flexible central portion. The central portion incorporates a bendable portion which is able to bend to accommodate turns, elbows and bends in the pipeline.

When a pipeline is constructed, it typically is straight, extending cross-country, having changes in grade and very modest changes in direction to accommodate changes in grade. Where the terrain raises or falls, the pipeline will bend very gently with that, it being appreciated that the angle of bend is quite small. Typically, a pipeline is constructed with a pump station located at spaced locations along the pipeline. Typically, the spacing is perhaps fifty miles between pump stations. The pump stations are incorporated to raise the pressure to overcome drag or friction as the pipeline delivers the flowing fluid. At the pump stations, there will be typically a number of bends or elbows which require a pig to flex as it travels around the bends or elbows.

Not only are there bends in a cross-country pipeline at the pump stations, there are a number of bends constructed in a pipeline from an offshore wellhead at a sub-sea location and extending to a gathering station on shore or at a remote elevated collection platform. Assume, as an example, that a productive oilfield is located offshore in the Gulf of Mexico. Assume that a number of wells are installed from the sub-sea surface into the producing formation. If several wells are provided with gathering lines, the gathering lines extend across the sub-sea location, perhaps a few hundred feet to a few miles, to a common gathering point. Again, the gathering point may be at the sub-sea location. There, several production streams are brought together and further processing occur. In some instances, the production will be delivered through a stand pipe or a riser extending to the surface and connecting with equipment located on the platform. The platform is typically a steel structure formed with multiple legs extending above the wave action so that the platform can handle passing storms. In this aspect, the production is delivered to the machinery at the platform, and flow is directed upwardly to the machinery deck well above the waves. If waves are estimated to have a maximum height of fifty feet, it is not uncommon to locate the machinery for the production platform sixty to ninety feet above the water line. In this instance, it may be necessary for all the production wells to connect with riser lines which extend up to the production platform equipment. Typically, this will involve a somewhat smaller pipe, perhaps four inches in nominal rating with at least three or four sharp elbows or bends in it. Focusing on that, the production of oil from a sub-sea formation runs the risk of paraffin coating in the pipeline. Specifically, the production oil may be at an elevated temperature. As a generalization, deeper formations produce oil at an elevated temperature dependent on the depth. As it flows to the wellhead, it may well be cooled, thereby changing the viscosity. As the viscosity is altered, the change in temperature encourages coating the inside diameter of the pipe with the heavier molecules of the flowing oil so that the effective diameter of the production line is reduced. This can be scraped to increase the diameter. It is necessary to scrape the pipeline often. It is necessary so that production through the line can continue at line capacity.

In one aspect of the present disclosure, the production from the line typically must flow just a few miles but it is sufficiently exposed to the cooling effect of the surrounding sub-sea location that the oil in the pipeline is cooled. As cooling occurs to the ambient temperature in the region, the coating problem can be severe.

Pigging of the line is somewhat difficult. Pigging of the line is difficult in part because the line is crooked with the bends just mentioned. Indeed, at the wellhead, the wellhead equipment may connect through an underwater Christmas tree to the production flow line and that line extends from that bend to another bend or elbow as the line is positioned on the ocean bottom and extends some distance to the production platform. Without regard to the distance, at the production platform, the line is then required to turn and extend vertically up the leg of the platform to equipment located at the equipment or pump deck of the platform. In that area, the equipment may involve another turn or two. At each location, the line may incorporate an elbow with either a sixty or a ninety degree bend. All these bends represent barriers to pig cleaning operations. They are especially a barrier to pigging the line from one end to the other to remove paraffin.

The present disclosure sets forth a pig which can be used to clean paraffin from the line. Better than that, the pipeline cleaning pig of this disclosure includes a central portion which is constructed without centralizing discs so that the central portion of the pig is free to bend. The central portion is made flexible so that it can bend to thereby enable the pig to pass through the elbows between the production wellhead equipment and the production platform. Elbows, and especially a ninety degree elbow, block flow, thereby enhancing the coating of paraffin just downstream from the elbow, and yet they prevent pig passage along the line and through the elbows. The pig of this disclosure can handle the turns encountered in flowing with the production fluids.

The pig of this disclosure is constructed with front and back end located discs. In addition to that, there are additional discs located between the two end discs. The discs on the end are made to a common diameter. The discs between the two end discs are made to a common diameter and are preferably made somewhat larger. For example, the discs located at the end of the pig function as guide discs. For this, they are preferably made smaller than the other discs and are formed of thicker material. They are constructed so that they are oversized meaning they are in the range of about one hundred one to about one hundred four percent of the open diameter of the pipe. This, of course, assumes the pipe is round, not oval in shape as a result of crushing. The end located discs will be described as the guide discs while the intermediate or captured discs along the body are described as sealing discs. The guide discs, having the range of about one hundred one to about one hundred four percent of the pipe I.D. are constructed so that guidance for the seal discs are readily achieved and the seal discs are constructed with even greater diameter but with a thinner disc to enhance sealing disc flexure. They are preferably about two to four percent greater in diameter than the guide discs. They are preferably about fifty to about seventy-five percent of the thickness of the guide discs. This enables the discs between the two ends to wear away and yet maintain the appropriate seal. This also enables them to flex, bend or vibrate with dragging movement during pigging operations. As will be understood, the dragging movement is part and parcel of maintaining a good seal. Even though the dragging movement may be reduced by the lubrication of the paraffin, that maintains a seal across the pig. It is important to have some sealing impact of the pig as it traverses the pipeline so that the pig is able to maintain an adequate seal from back to front.

Directing attention now to an important aspect of the present disclosure, it has been noted that the pig is preferably constructed with a unitary casting so that the entire pig can have a central portion that can be lengthened depending on requirements. More specifically, the pig length is altered by grouping all the discs at the front and back ends so that the central portion is substantially unsupported. This permits bending or flexing. Consider the instance where the pig must pass through a ninety degree elbow. In that particular situation, the central portion of the pig is constructed without discs and is able to bend as it turns the corner. In use, this permits the pig to turn the corner without destruction. It permits bending so that the pig can turn the corner at the bend without damaging the disc on the pig body.

SUMMARY OF THE INVENTION

This disclosure is directed to a single-piece construction pipeline pig formed with a set of discs, preferably having symmetrical disc deployment to the front and rear on both sides or flanking an elongate pig body. The central portion is unsupported. It is constructed of a urethane of sufficient softness to enable bending through a ninety degree bend so that the pig can travel through an elbow. Moreover, the pig is constructed with end located guide discs of a specified thickness and diameter, and sealing discs between the two ends. Even so, the sealing discs are separated by a substantial distance so that there is a central portion which can bend or flex.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

The single drawing is a side view of the circular pipe cleaning pip of the present disclosure showing end located guide discs, sealing discs between the two ends, and a central portion of substantial length having no discs wherein the central portion bends to enable the pig to travel through an elbow.

DETAILED DESCRIPTION OF A PREFERRED EMBODIMENT

Attention is now directed to the only drawing which shows a pipeline pig in accordance with the present disclosure. The pig 10 is a single-piece construction pig which has an elongate body 12 which body is constructed between a pair of symmetrical guide discs 14 and 16 at the remote front and back ends of the pig. The pig is circular in cross-section. The discs 14 and 16 are equal in diameter, thickness and hardness. All of these terms will be discussed later. The guide discs extend outwardly from the remote ends 18 and 20. The pig is made of solid cast polyurethane except that the pig is hollow in the region 22 as a weight reduction feature to thereby decrease the quantity of polyurethane material required in fabrication. This is duplicated at both ends. It is desirable to reduce the weight and thereby reduce the cost. The cavity 22 is of limited depth to avoid loss of strength or rigidity in the finished pig.

The pig is constructed with the transverse guide discs extending radially outwardly. The outer face 24 of the disc 14 forms an encircling cylindrical surface, thereby defining a region of contact against the pipe during cleaning. The diameter of the disc will be noted. In one aspect, the disc extends radially outwardly and is conveniently faired at the root of the disc as identified at 26, and such fairing is symmetrically provided on both faces of the disc. The disc 14 is positioned near the end, and the two guide discs sandwich thereby seal discs. At the left hand end of the drawing, a first seal disc 30 is shown and a parallel second seal disc 32 is also shown. The first and second discs are parallel, are spaced evenly along the length of the pig, and are again provided with a faired construction 34 at the root of each disc 30 and 32. Indeed, the same type fairing is included on both sides of the seal discs.

In the illustrated embodiment, the pig is constructed with two seal discs on the left hand end. It is also constructed with two similar discs 36 and 38 at the opposite end. This enables the pig to operate from either end so that it can travel in either direction. In that sense, both ends of the pig can serve as the leading end, and the opposite end is the rear end. The end which leads is the leading end while the following end is the rear end. The two seal discs at the left are symmetrical in location with respect to the centerline of the pig. In like fashion, the discs 36 and 38 are the mirror image of the discs on the left. As will be understood, the number of discs between the two guide discs is N disc where N is a whole number even integer, the preferred numbers being 2, 4, 6 and 8. It is possible to make a longer pig but there is not much benefit in incorporating ten discs on a pig which is required to bend.

In fact, if the pig were made much longer and supported perhaps ten to twenty discs, there would be a problem with turning even though there would be the ability of the pig to bend in the middle portions as will be described. In the exaggerated example just noted, such pig length would create difficulties with bending and would likely require a bending portion at two or three different locations along the length of the pig. The present version therefore preferably includes either 2, 4, 6, or 8 sealing discs, and they are preferably deployed with half on each end with a space there between.

The numeral 40 refers to the middle portion of the pig. The construction of the middle portion should be noted. The middle portion 40 has a length which is a portion of the total pig length which enables bending. The bending portion 40 is defined by the two closest sealing discs 32 and 36 in the particular embodiment illustrated. The bending portion 40 is in particular formed of the same material so that the entire pig is cast in a single pour and is constructed without internal seams or stratification. The pig body is cast in a mold conforming to the shape illustrated. Moreover, the pig body is constructed so that bending is concentrated in this region. For that reason, it is preferably made thinner and the sealing discs are omitted from this area for that reason. It is not made so thin that it will bend and break in that area. Rather, it is made thinner so that there is a distributed bend along the length of the bending portion 40. The bending portion 40 should have a length which is dependent in part on the nominal diameter of the pig. That, in turn, is tied to the nominal pipe diameter. Examples of this will be given below. The bending portion 40 should therefore be able to flex by distributing the bend through the bending portion 40. By incorporating the faired root region on the discs 32 and 36 and by tapering the several discs as illustrated, the pig is able to focus the bending in that region without undue bending at any particular location which might otherwise concentrate stress, thereby causing premature failure.

In providing a bendable pig so that elbows can be traversed in the pipeline, the pig construction is preferably made with a guide disc which is slightly oversized with respect to the I.D. of the pipe. Working with the actual ID, the guide disc 14 is sized so that it is about two to four percent larger for sizes ranging from about two inches to about twenty-four inches ID. Moreover, the seal disc is approximately two percent greater in diameter than the guide disc. The seal disc 30 is approximately forty to seventy percent of the thickness of the guide disc. It is thinner and is therefore more able to flex or deflect in travel. Being larger, there will be a greater drag force at the seal disc 30. In removing paraffin from a pipeline, the seal disc 30 will tend to wear away but the rate of wear is reduced by the lubricity of the paraffin in the pipeline. To be sure, the paraffin can become relatively hard, even coating and having the consistency of candle wax if permitted to go unchecked. Where softer, the seal disc will cut at least a portion of the paraffin. By incorporating more than one seal disc, a larger portion of the paraffin in the pipe will be cut and removed. Going now to the bending portion 40, it has a length of at least about two inches for a two inch nominal diameter pig. For a twelve inch pig, it preferably has a length of about eight inches or more and for a twenty-four inch pig, it has a length of about twenty inches. These are minimal lengths. Briefly, they are lengths which are sufficiently long to enable bending while traversing an elbow, keeping the disc in contact with the wall of the pipe, and without undue stress concentration during bending.

In one aspect of bending, the body of this pig can be extended even longer to travel through a typical wye connection, a bend of about 15° or more. In that instance, the disc at the front of the pig must maintain a seal on the downstream leg of the wye while the disc on the upstream end of the pig continue with sealing until the full length of the pig is pulled into the wye and then moves on with the flow. As will be understood, this may mandate a relatively long bendable portion 40. "The relatively long bendable middle portion 40 is able to flex at least about 15° in angular deflection. This flexure is located in the middle portion 40 where bending is distributed."

The preferred form of material is polyurethane which is cast in a single casting. It is preferable that the guide disc have a hardness of about eighty-five durometer on the Shore A scale. It is not necessary to make the sealing discs as hard. They are preferably about seventy to seventy-five durometer on the same scale. If convenience mandates, they can be made with the same hardness. As a generalization, an increase in hardness in the sealing disc provides slightly longer life but that the increased cost of using more material meaning the polyurethane is denser in that region.

Going now to the diameter of the system, the guide discs are made with about two to four percent oversized relative to the pipe. This can be as much as one-half inch in pigs as large as twenty-four inches diameter. As a generalization, that is more than adequate to establish and maintain a seal connection. The disc 30 provides the actual seal so that the pressure differential across the pig is maintained. In this instance, the pressure differential is established by making that disc much larger and permitting it to wear away during use. Ultimately, the pig has to be discarded when the several discs along the pig are sufficiently worn that the pressure differential across the pig is undermined by flow by. Dependent on the duties, the pig can be used until this occurs but it must then be discarded.

While the foregoing is directed to the preferred embodiment, the scope thereof is determined by the claims which follow.

The invention claimed is:

1. A single-piece, unitary cast, bidirectionally moveable paraffin scraping pig for use in a pipeline and comprising an elongate central body having a leading end and an opposite trailing end with a middle portion between said ends and said body is capable of flexing at least 15° and supports a leading end disc and at least two intermediate discs on said body, wherein at least one intermediate disc is near to the leading end disc, and at least one intermediate disc is near the trailing end of said body, wherein the middle portion of said elongate body is free to flex up to at least 15°, and said discs adjacent to said middle portion have a faired root joined to said body and wherein the outside diameter of said leading disc ranges from about 96% to 98% of the outside diameter of said intermediate discs and wherein the pipeline has an inside diameter and said leading disc outside diameter is at least about 102% of the inside diameter of the pipeline.

2. The apparatus of claim 1 wherein said leading disc is at least about 80 durometer and said leading disc is at least 10 durometer harder than said intermediate discs.

3. The apparatus of claim 1 wherein the leading disc is slightly thicker than said intermediate discs.

4. The apparatus of claim 1 including N spaced intermediate discs between said leading and rear discs where N is an integer between 2 and 6.

5. The apparatus of claim 1 including a symmetrically shaped rear disc of similar hardness and size to said leading disc.

6. The apparatus of claim 5 including N spaced intermediate discs between said leading and rear discs where N is an integer between 2 and 6.

7. The apparatus of claim 6 wherein N is an even nummber.

8. The apparatus of claim 7 wherein said leading disc is thicker than said intermediate disc.

9. A single-piece, unitary cast, bidirectionally moveable paraffin scraping pig for use in a pipeline and comprising an elongate central body having a leading end and an opposite trailing end with a middle portion between said ends and said body is capable of flexing at least 15° and supports a leading end disc and at least two intermediate discs on said body, wherein at least one intermediate disc is near to the leading end disc, and at least one intermediate disc is near the trailing end of said body, wherein the middle portion of said elongate body is free to flex up to at least 15° and wherein said leading disc is at least about 80 durometer and said leading disc is at least 10 durometer harder than said intermediate discs.

10. The apparatus of claim 9 wherein the outside diameter of said leading disc ranges from about 96% to 98% of the outside diameter of said intermediate discs and wherein the pipeline has an inside diameter and said leading disc outside diameter is at least about 102% of the inside diameter of the pipeline.

11. The apparatus of claim 9 wherein the leading disc is slightly thicker than said intermediate discs and said middle portion has a minimum length of 2" for a 2" diameter pig, 8" for a 12" diameter pig, and 20" for a 24" diameter pig.

12. The apparatus of claim 11 wherein there are N intermediate discs where N is an integer between 2 and 6 including a symmetrically shaped rear disc.

13. A unitary, cast, bidirectionally movable paraffin scraping pig comprising:

(a) an elongate central body wherein the elongate body has a leading end and an opposite trailing end and having a middle portion between said ends;

(b) a leading end disc extending radially outwardly from said body;

(c) at least two intermediate discs on said body wherein at least one intermediate disc is near the leading end disc, and at least one intermediate disc is near the trailing end of said body;

(d) said middle portion of said body is between said leading end and trailing end intermediate discs and said middle portion has sufficient length to enable flexure of at least about 15° to enable said pig to traverse a pipeline bend;

(e) wherein said leading disc has a hardness of at least about 80 durometer;

(f) wherein said intermediate discs have a hardness which is less than the hardness of the leading disc by at least 10 durometer;

(h) wherein the leading disc diameter is less than the diameter of said intermediate discs; and (i) wherein said intermediate discs adjacent to said middle portion have a faired root joining said discs to said middle portion.

14. A single-piece, unitary cast, bidirectionally moveable paraffin scraping pig for use in a pipeline and comprising an elongate central body having a leading end and an opposite trailing end with a middle portion between said ends and said body is capable of flexing at least 15° and supports a leading end disc and at least two intermediate discs on said body, wherein at least one intermediate disc is near to the leading end disc, and at least one intermediate disc is near the trailing end of said body, wherein the middle portion of said elongate body is free to flex up to at least 15°, and said discs adjacent to said middle portion have a faired root joined to said body and wherein said leading disc is at least about 80 durometer and said leading disc is at least 10 durometer harder than said intermediate discs.

15. The apparatus claim 14 wherein the outside diameter of said leading disc ranges from about 96% to 98% of the outside diameter of said intermediate discs and wherein the pipeline has an inside diameter and said leading disc outside diameter is at least about 102% of the inside diameter of the pipeline.

16. The apparatus of claim 14 wherein the leading disc is slightly thicker than said intermediate discs and said middle portion has a greater length for a larger diameter pipeline.

17. A single-piece, unitary cast, bidirectionally moveable paraffin scraping pig for use in a pipeline comprising an elongate central body having a leading end and an opposite trailing end with a middle portion between and said body is capable of flexing at least 15° and supports a leading end disc and at least two intermediate discs on said body, wherein at least one intermediate disc is near to the leading end disc, and at least one intermediate disc is near the trailing end of said body, wherein the middle portion of said elongate body is free to flex up to at least 15°, and said discs adjacent to said middle portion have a faired root joined to said body and wherein the leading disc is slightly thicker than said intermediate discs.

18. The apparatus of claim 17 wherein the outside diameter of said leading disc ranges from about 96% to 98% of the outside diameter of said intermediate discs and wherein the pipeline has an inside diameter and said leading disc outside diameter is at least about 102% of the inside diameter of the pipeline.

19. The apparatus of claim 17 including a symmetrically shaped rear disc of similar hardness and size to said leading disc.

20. A single-piece, unitary cast, bidirectionally moveable paraffin scraping pig for use in a pipeline having an inside diameter and comprising an elongate central body having a leading end and an opposite trailing end with a middle portion between said ends and said body is capable of flexing at least 15° and supports a leading end disc and at least two intermediate discs on said body, wherein at least one intermediate disc is near to the leading end disc, and at least one intermediate disc is near the trailing end of said body, wherein the middle portion of said elongate body is free to flex up, to at least 15° and said middle portion length increases with a pipeline larger diameter size wherein the outside diameter of said leading disc ranges from about 96% to 98% of the outside diameter of said intermediate discs and wherein the pipeline diameter and said leading disc outside diameter is at least about 102% of the inside diameter of the pipeline.

21. The apparatus of claim 20 wherein said leading disc is at least about 80 durometer and said leading disc is at least 10 durometer harder than said intermediate discs.

22. The apparatus of claim 20 wherein the leading disc is slightly thicker than said intermediate discs and said middle portion has a minimum length of 2" for a 2" diameter pig, 8" for a 12" diameter pig, and 20" for a 24" diameter pig.

* * * * *